US006560438B2

(12) United States Patent
Kosuge

(10) Patent No.: US 6,560,438 B2
(45) Date of Patent: May 6, 2003

(54) METHOD FOR REMOVING DEPOSIT FROM IMAGE SUBSTRATE AND IMAGE FORMATION APPARATUS USING THE METHOD

(75) Inventor: Akio Kosuge, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/978,097

(22) Filed: Oct. 17, 2001

(65) Prior Publication Data

US 2002/0037189 A1 Mar. 28, 2002

(30) Foreign Application Priority Data

Oct. 18, 2000 (JP) ..... 2000-317374
Apr. 19, 2001 (JP) ..... 2001-120787
Sep. 12, 2001 (JP) ..... 2001-276754

(51) Int. Cl.[7] ..... G03G 21/00
(52) U.S. Cl. ..... 399/350; 399/71
(58) Field of Search ..... 399/71, 76, 97, 399/98, 343, 346, 349, 350, 353, 354, 358, 359; 15/1.51, 256.5, 256.51

(56) References Cited

U.S. PATENT DOCUMENTS 4,499,849 A 2/1985 Tomita et al. ..... 118/652
4,547,059 A 10/1985 Nagayama et al. ..... 399/165
4,571,070 A 2/1986 Tomita ..... 399/164
5,105,222 A 4/1992 Ohta et al. ..... 399/159
5,530,538 A * 6/1996 Godlove ..... 399/350 X
6,122,648 A 9/2000 Sakamoto et al. ..... 399/223
6,249,304 B1 6/2001 Sawayama et al. ..... 347/228
6,295,437 B1 9/2001 Hodoshima et al. ..... 399/346
6,308,027 B1 10/2001 Obu et al. ..... 399/110
6,405,015 B1 * 6/2002 Suzuki ..... 399/350
6,438,337 B1 * 8/2002 Abe ..... 399/343 X

FOREIGN PATENT DOCUMENTS

| | | |
|---|---|---|
| EP | 0 926 559 | 6/1999 |
| JP | 5-107991 | 4/1993 |
| JP | 5-181295 | 7/1993 |
| JP | 6-67500 | 3/1994 |
| JP | 10-91049 | 4/1998 |
| JP | 11-219086 | 8/1999 |
| JP | 2000-39819 | 2/2000 |
| JP | 2000-47545 | 2/2000 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image formation apparatus contains (1) an image substrate, (2) a rotating unit that rotates the image substrate, (3) a bias applying unit which applies a charge bias to the image substrate, (4) a development unit that supplies a toner onto the image substrate, and (5) a cleaning blade that removes the material deposited on the image substrate, and the image formation apparatus is used for a deposit removal operation which is performed at a predetermined time while no charge bias is applied. The deposit removal operation includes rotating the image substrate, supplying the toner to the image substrate to an extent that an upcurve of the cleaning blade is not caused, and removing the deposited material.

17 Claims, 8 Drawing Sheets

METHOD FOR REMOVING DEPOSIT FROM IMAGE SUBSTRATE AND IMAGE FORMATION APPARATUS USING THE METHOD

FIELD OF THE INVENTION

The present invention relates to image formation apparatuses such as copiers, printers, facsimile machines, or compound machines of these. More particularly, the present invention relates to electrophotographic image formation apparatuses wherein charging, recording, development, transfer, cleaning and the like are repeated to form toner images on image substrates sequentially, and the toner images are transferred sequentially to record the images onto a transfer material such as a sheet of paper, an OHP film, an intermediate transfer material, or the like. More specifically, the present invention relates to a method of removing deposit from the image substrate, and an image formation apparatus using the method, wherein deposit, such as discharge products deposited on the image substrate in the image formation apparatus, is removed.

BACKGROUND OF THE INVENTION

Conventionally, in electrophotographic image formation apparatuses, when a charge bias is applied on the image substrate, discharge products such as ozone, nitrogen oxides and the like get deposited on the image substrate. As a result, there is a flow of charge through the deposited section causing image deletion, and image quality of the toner image recorded on the transfer material is thus degraded.

In conventional image formation apparatuses, after the toner image is transferred onto the transfer material from the image substrate, transfer residual toner remaining on the image substrate is removed with a cleaning device. During this cleaning, the cleaning device, which is generally a cleaning blade, removes a portion of a photosensitive layer of the image substrate along with the deposited discharge products.

It is disclosed in Japanese Laid Open Patent Application No. 2000-47545 that, existence of nitrates deposited on the photosensitive body surface is detected when a driving torque of a photosensitive body reaches a predetermined torque. If the existence of nitrates is detected, only then a developer is supplied actively to the photosensitive body that is rotated to clean the body by scraping off the nitrates together with the developer.

Further, Japanese Laid Open Patent Application No. 2000-39819 discloses formation of toner image for cleaning by following method. That is, switching off the charge bias of a charging unit; not exposing with an exposure unit; and switching on intermittently a DC component of a development bias of a development unit.

Moreover, Japanese Laid Open Patent Application No. 2000-39819 discloses formation of toner image for cleaning by following method. That is, switching on intermittently the DC component of the charge bias of the charging unit, not exposing with the exposure unit, and switching on intermittently the DC component of the development bias of the development unit; or by switching on continuously the DC component of the charge bias of the charging unit, exposing intermittently with the exposure unit, and switching on continuously the DC component of the development bias of the development unit.

Following measures have been taken in the past to improve the life span of the image substrates. For example, surface of the image substrate is covered with a photosensitive layer comprising a hard protective layer for preventing abrasion of the photosensitive layer, or the photosensitive layer is composed of hard amorphous silicon. However, in such cases, the photosensitive layer cannot be properly scraped off with the cleaning device. In other words, there is a problem that the deposit entrapped inside concaves on the surface of the image substrate cannot be removed completely.

There are known image formation apparatuses that use toners containing abrasive particles. The toner is actively deposited onto the image substrate to form toner image, and the toner image is transmitted to the edges of the cleaning blade instead of being transferred onto the transfer material, and the deposit on the image substrate together with the toner are scraped off.

SUMMARY OF THE INVENTION

It is an object of the present invention to provide an image formation apparatus which can completely removal deposit such as residual toner from an image substrate that has a hard layer on its surface.

It is another object of the present invention to enable the removal of the deposit without having to secure an independent period of time especially for the removal, without disturbing an image formation operation.

It is still another object of the present invention to remove the deposit regularly in order to prevent degradation of image quality on the transfer material infallibly.

It is still another object of the present invention to make the removal of the deposit executable particularly when required in accordance with surrounding environment.

It is still another object of the present invention to operate the removal of the deposit during operations other than the image formation operation, such that the deposit removal operation does not interfere with the image formation operation.

It is still another object of the present invention to deposit a toner to an optimum extent that prevents upcurve of the cleaning blade, onto the image substrate, in order to facilitate the removal of deposit during the deposit removal operation using a configuration that is as simple as possible.

It is still another object of the present invention to improve cleaning performance in order to achieve complete removal of the deposit such as discharge products from the image substrate, while preventing any upcurve of the cleaning blade.

It is still another object of the present invention to prevent "filming", to minimize depositing on the image substrate and to enhance detachment of the deposit from the image substrate.

It is still another object of the present invention to provide an image formation apparatus wherein one or more of the above-mentioned objects are achieved.

The image formation apparatus according to the present invention comprises: an image substrate having a surface, a rotating unit that rotates said image substrate, a bias applying unit which applies a charge bias to said surface of said image substrate; a development unit that supplies a toner onto said surface of said image substrate; and a cleaning unit which includes a cleaning blade that removes the material deposited on said surface of said image substrate. This image formation apparatus performs a deposit removal operation at a predetermined time while no charge bias is applied to said surface of said image substrate. The deposit removal operation includes rotating the image substrate, supplying the toner to said surface of said image substrate to an extent that upcurve of the cleaning blade is not caused, and removing the deposited material on said surface of said image substrate.

Other objects and features of this invention will become apparent from the following description with reference to the accompanying drawings.

DESCRIPTION OF THE PREFERRED EMBODIMENTS

Embodiments of the present invention will be explained in detail while referring to accompanying drawings.

Figure 1:
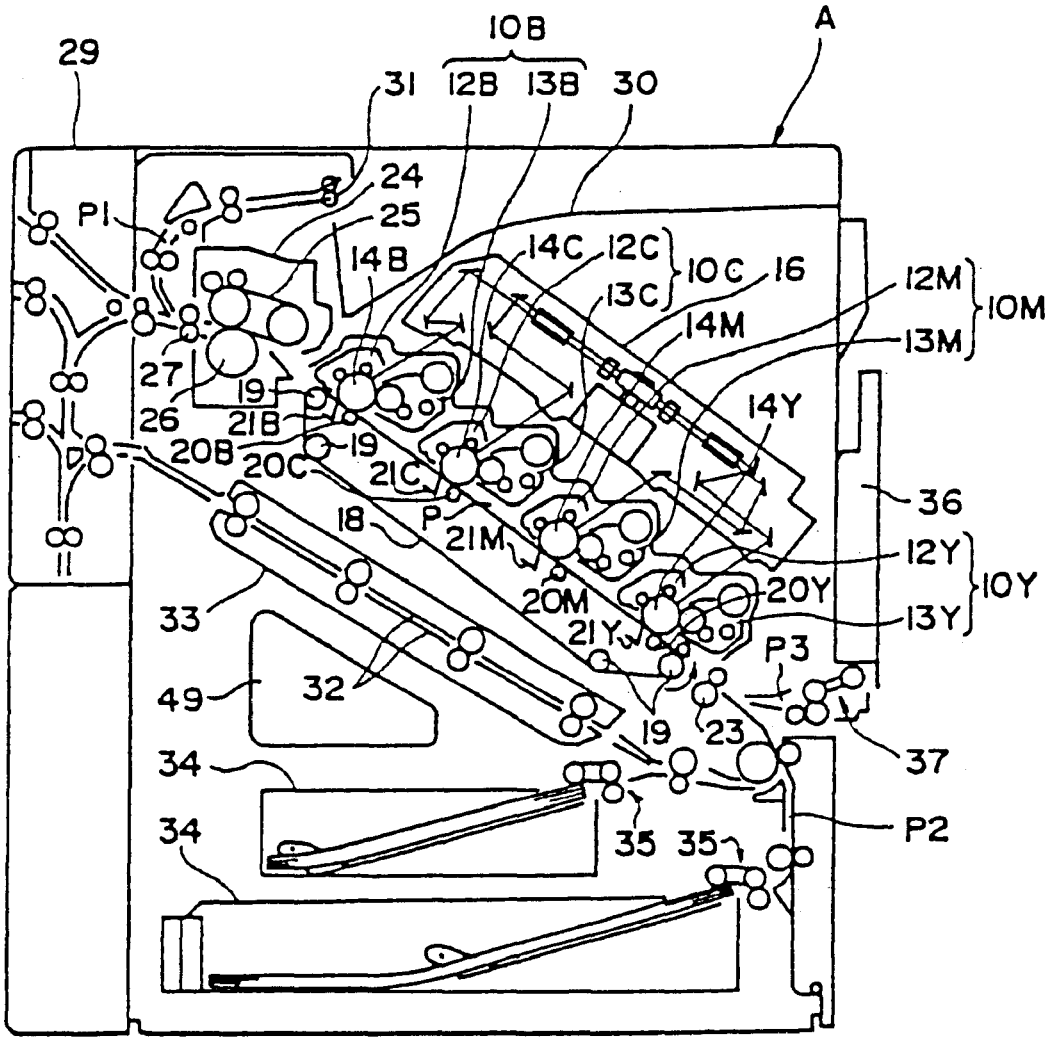
FIG. 1 shows the whole schematic structure of a small-size color printer, which is an example of an image formation apparatus using a method, for removing deposit from an image substrate, according to the invention.

FIG. 1 shows the whole schematic structure of a small-size color printer. This color printer is an example of the image formation apparatus that uses the method of removing deposit from the image substrate according to the present invention.

The reference symbol A in FIG. 1 represents an apparatus main body of the printer. In the apparatus main body A, a transfer material conveyance path P is provided diagonally from lower right-hand side to upper left-hand side.

On the transfer material conveyance path P, four single-color image formation units 10Y, 10M, 10C, and 10B, for yellow, magenta, cyan, and black respectively, are lined up in tandem, along the conveyance path P, from the lower right-hand side to the upper left-hand side in the above order. Each single-color image formation unit 10 comprises an image substrate unit 12Y, 12M, 12C, or 12B and a development unit 13Y, 13M, 13C, or 13B. These units are removably placed on the apparatus main body A. Each image substrate unit which will be described in detail later, comprises a drum-shaped image substrate 14Y, 14M, 14C or 14B.

Above the single-color image formation units 10Y, 10M, 10C, and 10B, a recording unit 16 is provided diagonally along a line of these single-color image formation units 10.

Below the single-color image formation units 10Y, 10M, 10C, and 10B, an endless-belt-shaped transfer material substrate 18 is extended, with the transfer material conveyance path P in between the image formation units 10 and the transfer material substrate 18. The transfer material substrate 18, in the example, covers around four support rollers 19, contacting the image substrates 14Y, 14M, 14C, and 14B, providing a section of the transfer material substrate 18 along the transfer material conveyance path P, and is rotated for conveyance in a counterclockwise direction in the figure, by a drive device not shown.

Inside the transfer material substrate 18, backup rollers 20Y, 20M, 20C and 20B and transfer brushes 21Y, 21M, 21C, and 21B are provided respectively corresponding to each image substrate 14Y, 14M, 14C, or 14B. The backup rollers 20Y, 20M, 20C and 20B tightly contact the transfer material substrate 18 and the transfer material with the image substrates 14Y, 14M, 14C, and 14B. Transfer bias is provided, to the transfer brushes 21Y, 21M, 21C and 21B, by a power source not shown. Although the transfer brush is used in the example, a non-contact charger may be used instead.

Along the transfer material conveyance path P, a resistant roller pair 23 is provided in an upstream position of the transfer material substrate and a fixing unit 24 is provided in a downstream position of the transfer material substrate. In the fixing unit 24, a pressure roller 26 is pressed against an endless-belt-shaped fixing belt 25, and an ejection roller pair 27 is provided at an outlet.

In a downstream position of the fixing unit 24, a reversal unit 29 is attached to the apparatus main body A. The reversal unit 29, ejects the transfer material straight away, ejects it after reversing it, or conveys it back to the apparatus main body A again.

Moreover, in the downstream position of the fixing unit 24, a reversal paper-ejection path P1, branching away from the transfer material conveyance path P, is provided. Beyond the path P1, an ejection roller pair 31, for ejecting the transfer material toward a paper-ejection stack section 30 placed on top of the apparatus main body A, is provided.

A paper re-feed unit 33, for guiding the transfer material reversed in the reversal unit 29, between a pair of guide plates 32 to refeed the material to the apparatus, is placed below the transfer material substrate 18, diagonally along an extending direction of the substrate 18.

Two paper-feed cassettes 34 are stacked below the paper re-feed unit 33. In each of these paper-feed cassettes, transfer materials, such as paper, OHP films, or the like, having a different size from that in the other cassette, is loaded and contained. Furthermore, a paper-feed section 35 is provided in each cassette, for separating and feeding sheets of the transfer material, sheet by sheet.

On a right-hand side of the paper-feed section 35 in the figure, a paper-feed path P2 is provided for guiding the transfer material fed from the paper-feed section 35 and the transfer material re-fed through the paper-refeed unit 33, toward the resistant roller pair 23 of the transfer material conveyance path P.

In addition, a manual-feed section is provided on a right-hand side of the apparatus main body A in the figure, where a manual-feed tray 36 that can be opened and closed is installed. The manual-feed section comprises a paper-feed section 37 for separating and feeding sheets of transfer material on the manual-feed tray 36, sheet by sheet, and a manual paper-feed path P3 for guiding the transfer material fed from the paper-feed section 37 toward the resistant roller pair 23.

When an image is to be recorded onto the transfer material using this color printer, the paper-feed section 35 is selectively driven according to signals coming from, for example, a host. The paper-feed section 35 then separates and lets out sheets of transfer material from the paper-feed cassette 34 sheet by sheet, sending them through the paper-feed path P2 until they are stopped against the resistant roller pair 23. Otherwise, the manual paper-feed section 37 may be driven to separate and let out sheets of transfer material on the manual-feed tray 36 sheet by sheet, sending them through the manual paper-feed path P3 until they are stopped against the resistant roller pair 23.

In each single-color image formation unit 10Y, 10M, 10C, or 10B, its image substrate 14Y, 14M, 14C, or 14B, is rotated to form a single-color toner image of yellow, magenta, cyan, or black, respectively on each image substrate. At the same time, a drive motor not shown rotates one of the support rollers 19 to slave the other support rollers 19, in order to rotate the transfer material substrate 18 for conveyance.

The resistant roller pair 23 is rotated with a timing in accordance with rotations of the image substrates, to send the transfer material, through the transfer material conveyance path P between the single-color image formation units (10Y, 10M, 10C, and 10B) and the transfer material substrate 18, to convey the transfer material by rotation of the transfer material substrate 18. Simultaneously, the single-color toner image on individual image substrate 14Y, 14M, 14C, or 14B is transferred with the transfer brush 21Y, 21M, 21C, or 21B, onto the transfer material to record a compound full-color image.

The transfer material with the image transferred onto it is fed to the fixing unit 24, where the transferred image is then fixed, and subsequently ejected from the ejection roller pair 27. When the transfer material is to be ejected facedown, a switch-nail not shown switches the direction of the transfer material to be led to the reversal paper-ejection path P1, and the transfer material is then ejected from the ejection roller pair 31 onto the paper-ejection stack section 30 to be stacked in order of pages.

When the transfer material is to be ejected faceup, a switch-nail not shown switches the direction of the transfer material to be led to the reversal unit 29 and ejected straight away.

When recording is to be done on the other side of the transfer material with its one side already recorded, a switch-nail not shown similarly changes direction of the transfer material to be led to the reversal unit 29. The transfer material is reversed in the reversal unit 29, led to the paper-refeed unit 33, and sent through the paper-feed path P2 again until it is stopped against the resistant roller pair 23.

Subsequently, the transfer material is sent through the transfer material conveyance path P again, between the single-color image formation units (10Y, 10M, 10C, and 10B) and the transfer material substrate 18. After recording a compound full-color image on the other side of the transfer material, the image is fixed in the fixing unit 24, and the transfer material is passed through the reversal paper-ejection path P1 to be ejected from the ejection roller pair 31 and stacked onto the paper-ejection stack section 30.

The single-color image formation units 10Y, 10M, 10C, and 10B will now be explained in detail below.

Figure 2:
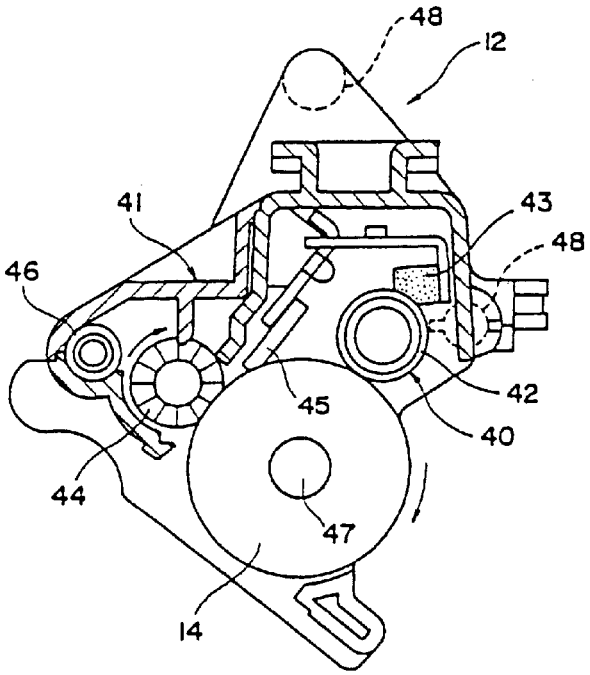
FIG. 2 shows a cross section of an image substrate unit that is used for the printer shown in FIG. 1.

Each image substrate unit 12 (12Y, 12M, 12C, or 12B) of the individual single-color image formation unit 10Y, 10M, 10C, and 10B respectively, as shown in FIG. 2, comprises a charging device 40 and a cleaning device 41 around its drum-shaped image substrate 14 (14Y, 14M, 14C, or 14B) described in detail later.

A roller-shaped charging member 42 of the charging device 40 is arranged adjacent to the image substrate 14 and the charging device 40 charges the image substrate 14 by applying a charge bias between the charging member 42 and the image substrate 14. A cleaner, made of sponge or the like, for cleaning the surface of the charging member 42 contacts the charging member 42. Although in the example, the charging member 42 is roller-shaped, a generally known non-contact charger may be used instead.

The cleaning device 41 comprises: a rotatable fur brush 44 such that the peripheral surface of the brush 44 contacts the image substrate 14; and a cleaning blade 45 made of, for example, polyurethane rubber wherein a tip of the blade 45 is pressed against the image substrate 14. The reference numeral 46 represents a recovery screw.

The fur brush 44 is rotated in an opposite direction relative to the image substrate 14, to clean the transfer residual toner remaining on the image substrate 14 after the image is transferred. After that, the toner still remaining on the image substrate 14 is scraped off and removed with the cleaning blade 45. The toner removed with the fur brush 44 and cleaning blade 45, is ejected out from each single-color image formation unit 10Y, 10M, 10C, or 10B, by rotation of the recovery screw 46 in the example, and passed through the waste-toner conveyance path not shown provided in the apparatus main body A, to reach a waste-toner bottle 49.

Each image substrate unit 12 comprises a section 47 as a primary reference and two sections 48 as secondary references, for aligning and placing the image substrate unit accurately against the apparatus main body A.

One-component developers may be used in the development units 13Y, 13M, 13C, and 13B that are the development devices of the respective single-color image formation units 10Y, 10M, 10C and 10B, although in the example, a two-component developer composed of a magnetic carrier and a non-magnetic toner, is used. Colors of the toner used as the non-magnetic toner are yellow for the development unit 13Y, magenta for the development unit 13M, cyan for the development unit 13C and black for the development unit 13B.

In the individual single-color image formation unit 10Y, 10M, 10C, or 10B, surface of the corresponding image substrate 14 is charged evenly by applying a charge bias with the charging device, while the image substrate is rotated in a clockwise direction indicated in FIG. 2. Subsequently, recording is done with a scanning light by the recording unit 16, to form an electrostatic latent image on the surface of the image substrate 14. The toner is adhered onto the image substrate 14 in each development unit 13 (13Y, 13M, 13C, and 13B) and the electrostatic latent image is developed, to form a single-color toner image.

A single-color toner image that is yellow, magenta, cyan or black, is formed individually on the single-color image formation units 10Y, 10M, 10C, and 10B, respectively.

Each development unit 13 comprises a detection sensor, for detecting toner concentration, although the sensor is omitted in the diagram.

The recording unit 16 will now be explained in detail below.

Figure 3:
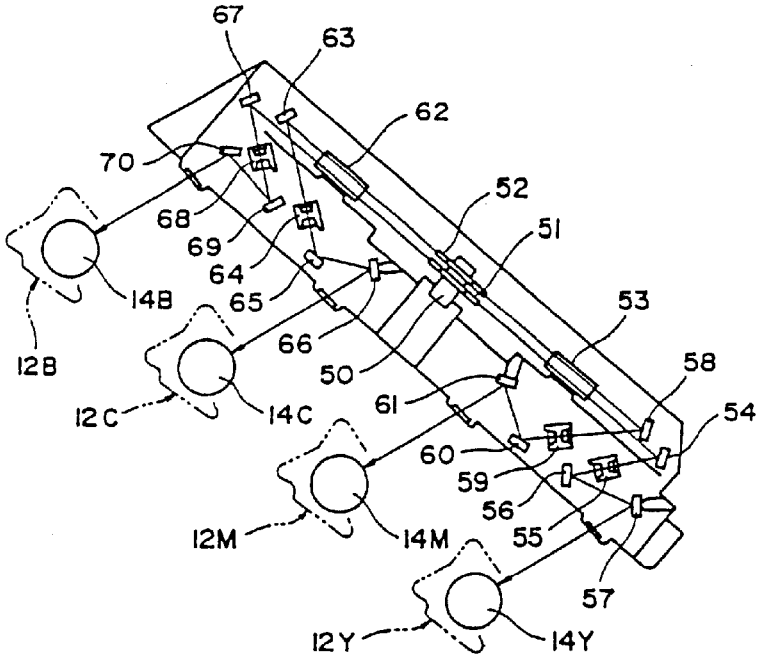
FIG. 3 shows a schematic structure of a recording unit that is used for the printer shown in FIG. 1.

The recording unit 16 comprises, as shown in FIG. 3, two hexahedral-rotating-polygon-mirrors 51 and 52, which can be rotated by a polygon motor 50. Outgoing beam from a laser diode not shown is dispersed into scanning lights for yellow, magenta, cyan, and black and these lights are reflected, by rotation of the rotating polygon mirrors 51 and 52.

The scanning light for yellow, penetrates through an fθ lens 53, reflects at a mirror 54, penetrates through a long WTL 55, reflects at mirrors 56 and 57, and irradiates the image substrate 14Y in the image substrate unit 12Y.

The scanning light for magenta, penetrates through an fθ lens 53, reflects at a mirror 58, penetrates through a long WTL 59, reflects at mirrors 60 and 61, and irradiates the image substrate 14M in the image substrate unit 12M.

The scanning light for cyan, penetrates through an fθ lens 62, reflects at a mirror 63, penetrates through a long WTL 64, reflects at mirrors 65 and 66, and irradiates the image substrate 14C in the image substrate unit 12C.

The scanning light for black, penetrates through an fθ lens 62, reflects at a mirror 67, penetrates through a long WTL 68, reflects at mirrors 69 and 70, and irradiates the image substrate 14B in the image substrate unit 12B.

The image substrates 14 used in the respective image substrate units 12 will now be described in detail below.

Figure 4A:
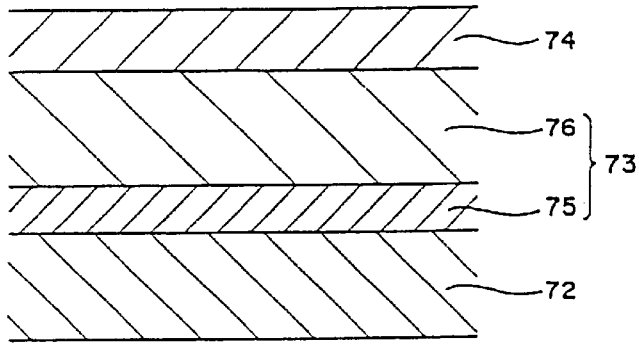
FIG. 4A shows a partial cross-sectional structure of an image substrate used for the printer shown in FIG. 1.
Figure 4B:
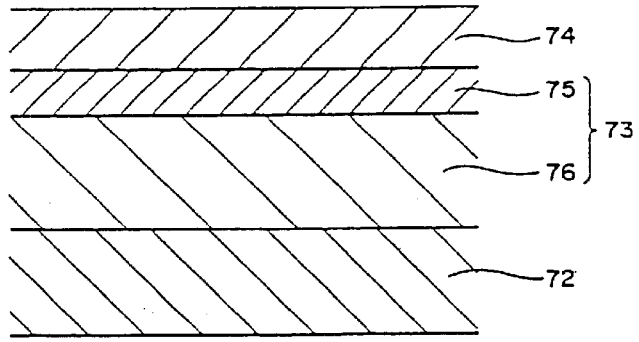
FIG. 4B shows a partial cross-sectional structure of another image substrate.

As shown in FIG. 4A or 4B, the image substrate 14 is formed from a conductive base material 72 with a photosensitive layer 73 on top of the base material 72, and a protective layer 74 on top of the photosensitive layer 73. The photosensitive layer 72 is made up of a charge generation layer 75 and a charge transport layer 76. The charge transport layer 76 may be provided on top of the charge generation layer 75 as shown in FIG. 4A, or vice versa as shown in FIG. 4B.

The conductive base material 72 is made of, a material having a conductivity such that its volume resistivity is 1010 Ω• cm or lower, for example: film-like or cylindrical plastic or paper coated with metals (such as aluminium, nickel, chromium, nichrome, copper, silver, gold, platinum, or the like) or metal oxides (such as tin oxide, indium oxide, or the like), by deposition or spattering; a plate of aluminium, aluminium alloys, nickel, stainless or the like; or a pipe of aluminium, aluminium alloys, nickel, stainless or the like, which has been made into a base pipe, and surface-treated by cutting, super finishing, polishing, and the like.

The charge generation layer 75 is principally composed of a charge generation material. As the charge generation material, inorganic or organic materials can be used, which are typically, monoazo pigments, disazo pigments, trisazo pigments, perylene pigments, perynone pigments, quinacridone pigments, quinone condensed-polycyclic-compounds, squalic acid dyes, phthalocyanine pigments, naphthalocyanine pigments, azulenium salt dyes, selenium, selenium-tellurium alloy, selenium-arsenic alloy, amorphous silicon and the like. One of these charge generation materials may be used by itself, or a mixture of any two or more of them may be used.

The charge generation layer 75 can be prepared by dispersing the charge generation material appropriately with a binder resin, in a solvent such as tetrahydrofuran, cyclohexanone, dioxane, 2-butanone, dichlorethane, or the like, using a ball-mill, attritor, sand-mill, and applicating the dispersion liquid obtained. Application of the dispersion liquid can be done by dip-coating, spray-coating, bead coating, or the like.

Examples of the binder resins which can be appropriately used are polyamide resins, polyurethane resins, polyester resins, epoxy resins, polyketone resins, polycarbonate resins, silicone resins, acrylic resins, polyvinyl butyral resins, polyvinyl formal resins, polyvinyl ketone resins, polystyrene resins, polyacrylic resins, polyamide resins, or the like. The amount of the binder resins relative to 1 part of the charge generation material is 0 to 2 parts, on weight basis.

The charge generation layer 75 may also be prepared by a generally known vacuum thin film formation method. The coating thickness is usually between 0.01 and 5 μm, preferably between 0.1 and 2 μm.

The charge transport layer 76 is prepared by: dissolving or dispersing a charge transport material and a binder resin in an appropriate solvent; and applicating and drying the liquid obtained. If required, a plasticizer, a leveling agent, or the like may be also added.

Out of the charge transport material, low-molecular-weight charge transport materials can be grouped into electron transport materials and hole transport materials. Examples of the electron transport materials for use are electron-accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophen-5,5-dioxide and the like. One of these electron-accepting substances maybe used singly, or a mixture of any two or more of them may be used.

Examples of the hole transport materials for use are electron-donating substances such as derivatives of oxazole, oxidiazol, imidazole, or triphenylamine; 9-(p-diethylaminostyryl anthracene), 1,1-bis-(4-dibenzylaminophenyl)propane, styryl anthracene, styryl pyrazoline, phenyl hydrazones; derivatives of α-phenylstilbene, thiazole, triazole, phenazine, acridine, benzofuran, , benzoimidazole, thiophene, and the like. One of these electron-accepting substances maybe used singly, or a mixture of any two or more of them may be used.

When a high-molecular-weight charge transport material is used as the charge transport material, the charge transport layer 76 can be prepared by: dissolving or dispersing the material in an appropriate solvent; and applicating and drying the liquid obtained. The high-molecular-weight charge transport material for use is composed of the low-molecular-weight charge transport material that has a charge transport substituent in its principal chain or its side chain. Further, if required, an optimum amount of the binder resin, the low-molecular-weight charge transport material, a plasticizer, a leveling agent, a lubricant, or the like may be added to the high-molecular-weight charge transport material.

Examples of the binder resins which can be used with the charge transport material to prepare the charge transport layer 76 are thermoplastic or thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, acrylic resins, silicone resins, epoxy resins, melamine resins, urethane resins, phenol resins, alkyd resins, and the like.

Examples of solvents for use are tetrahydrofuran, dioxane, toluene, 2-butanone, monochlorbenzene, dichlorethane, methylene chloride and the like.

Thickness of the charge transport layer 76 can be selected, in accordance with desired properties of the image substrate, from a range between 5 and 30 μm.

Examples of the plasticizer that may be added in the charge transport layer 76 if desired are, dibutylphthalate, dioctylphthalate, and the like, which are general-purpose plasticizers for resins. The amount of the plasticizer added, is preferably between 0 and 30% by weight in relation to that of the binder resin.

Examples of the leveling agent, which may be added if desired in the charge transport layer 76, are: silicone oils such as dimethyl silicone oil, methylphenyl silicone oil and the like; and polymers or oligomers having a perfluoroalkyl group in their side chain. The amount of the leveling agent added is preferably between 0 and 1% in relation to that of the binder resin.

Content of the charge transport material in the photosensitive layer 73 is preferably 40% or more by weight of the charge transport layer 76. If the content is less than 40% by weight, it is not preferable, as optical attenuation time, required for pulse optical exposure during laser recording onto the image substrate in case of a high-speed electrophotographic process, cannot be obtained sufficiently.

Mobility of the charge transport layer in the image substrate 14, is preferably 3×10−5 cm2/V•s or greater, and more preferably 7×10−5 cm2/V•s or greater, when electric-field-strength of the charge transport layer is 2.5×105 to 5.5×105 V/cm. The mobility can be adjusted accordingly to reach the above mobility under various use conditions. The mobility can be measured by a conventional generally known TOF method.

In the image substrate 14, an under-coating layer can be formed between the conductive base material 72 and the photosensitive layer 73. Generally, the under-coating layer is principally composed of resins. These resins are preferably resins having high solvent resistance against general organic solvents, considering that the photosensitive layer is to be applicated on top of the resins.

Examples of the resins which can be used are: water soluble resins such as polyvinyl alcohol resins, casein, sodium polyacrylate and the like; alcohol soluble resins such as nylon copolymers, methoxymethyl nylon and the like; and setting resins which form three-dimensional network structures, such as polyurethane resins, melamine resins, alkyd-melamine resins, epoxy resins and the like.

For prevention of moire, reduction of rest potential, and the like, particles of metal oxides such as titanium oxide, silica, alumina, zirconium oxide, tin oxide, indium oxide and the like may be added to the under-coating layer.

The under-coating layer may be prepared, like the photosensitive layer 72, using an appropriate solvent and coating method. Moreover, a metal oxide layer prepared by sol-gel method or the like using a silane coupling agent, titanium coupling agent, chromium coupling agent, or the like, can be effectively used as the under-coating layer.

Furthermore, a layer prepared by anodizing A1203; or a layer prepared by vacuum thin film preparation method using organic substances such as polyparaxylylene (parylene) or the like, or inorganic substances such as SiO, SnO2, TiO2, ITO, CeO2 or the like, can be used as the under-coating layer. Coating thickness of the under-coating layer is between 0 and 5 μm.

In the image substrate 14, the protective layer 74 as a surface layer, is to be formed on top of the photosensitive layer 73, for protection and improvement in durability of the photosensitive layer 73.

Examples of the material to be used for the protective layer 74 are resins such as ABS resins, ACS resins, olefin-vinyl monomer copolymers, chlorinated polyether resins, aryl resins, phenol resins, polyacetal resins, polyamide resins, polyamideimide resins, polyacrylate resins, polyaryl sulfone resins, polybutylene resins, polybutylene terephthalate resins, polycarbonate resins, polyether sulfone resins, polyethyne resins, polyethyleneterephthalate resins, polyimide resins, acrylic resins, polymethyl pentene resins, polypropylene resins, polyphenylene oxide resins, polysulfone resins, AS resins, AB resins, BS resins, polyurethane resins, polyvinyl chloride resins, polyvinylidene choloride resins, epoxy resins and the like. A filler is added to the protective layer 74 in order to improve its abrasion resistance.

Examples of the filler for use are: fluorine resins such as polytetrafluoroethylene and the like and silicone resins; these resins wherein inorganic materials such as titanium oxide, tin oxide, potassium titanate and the like are dispersed inside; and the like.

The amount of the filler to be added to the protective layer 74 on weight basis is typically 10 to 40%, preferably 20 to 30%. If the amount is less than 10% by weight, abrasion occurs severely and the durability becomes low. On the other hand, if the amount is more than 40% by weight, electric potential of a bright spot during exposure increases significantly, that decrease in sensitivity becomes non-negligible.

In addition, a dispersion assistant may be added to the protective layer 74 to improve dispersibility of the filler. Dispersion assistants used in paints or the like may be appropriately used as the dispersion assistant to be added. Amount of the dispersion assistant to be added on weight basis is typically between 0.5 and 4%, preferably between 1 and 2%, in relation to that of the filler.

The above-mentioned charge transport material may be also effectively used for addition to the protective layer 74, and an antioxidant that will be described later may also be added further if required.

As a method of forming the protective layer 74, a typical application method such as a spray method or the like may be used.

Thickness of the protective layer 74 is between 0.5 and 10 μm, preferably between 4 and 6 μm.

It is important in terms of abrasion resistance and image characteristics, to make existing state of the filler in the protective layer 74 constant. That is, existence of the protective layer 74 does not impair the sensitivity and electrostatic stability of the photosensitive layer 73 and fineness of exposure. As the protective layer 74 has enough abrasion resistance to be made into a thin film, it can contribute to further refinement and high-speed responsiveness.

To keep the existing state of the filler in the protective layer 7, it is required that the content of the filler in any cross section of the protective layer 74 occupies 3 to 5% of the area in that plane. Further, in a particle diameter distribution, including secondary particles, of the filler in the protective layer, it is required, that there is a peak between 0.2 and 0.3 μm, and that the area occupied by the filler having a particle size of 0.3 μm or larger in any cross section of the protective layer 74 is between 10 and 30% of the area occupied by all the filler in that plane. As a result of investigation carried out by the inventor(s), it was found that if the distribution and the area do not satisfy these conditions, increase in the rest potential, decrease in the sensitivity, degradation in resolution, decrease in the abrasion resistance, and generation of abnormal image caused by "filming", are observed.

The existing state of the filler in the protective layer 74 can be controlled by adjusting the particle diameter of the filler material used, the particle diameter distribution and composition of the coating liquid, and by a coating device. Addition of the dispersion assistant is also effective.

Another intermediate layer may be formed in between the photosensitive layer 73 and the protective layer 74. Typically, this intermediate layer is principally composed of a binder resin. Examples of the binder resin which may be used are polyamide resins, alcohol soluble nylons, water soluble polyvinyl butyral resins, polyvinyl butyral resins, polyvinyl alcohol resins and the like. The above-mentioned typical coating methods can be used as a method of forming the intermediate layer. Thickness of the intermediate layer is preferably between 0.05 and 2 $\mu$m.

To improve environmental resistance, especially in order to prevent the reduction in sensitivity and the increase in rest potential, an antioxidant, a plasticizer, lubricant, an ultraviolet light absorbent, a low-molecular-weight charge transport substance and a leveling agent may be added in each layer.

Examples of the antioxidant which may be added to each layer are: phenol compounds of 2,6-di-t-butyl-p-cresol, butylated hydroxyanisole, 2,6-di-t-butyl-4-ethylphenol, n-octadecyl-3-(4-hydroxy-3,5-di-t-butylphenol), 2,2-methylene-bis-(4-methyl-6-t-butylphenol), 2,2-methylene -bis--(4-ethyl-6-t-butylphenol), 4,4-thiobis-(3-methyl -6-t-butylphenol), 4,4-butylidenebis-(3-methyl-6-tbutylphenol), 1,1,3-tris-(2-methyl-4-hydroxy-5-tbutylphenyl)butane, 1,3,5-trimethyl-2,4,6-tris(3,5-di -t-butyl-4-hydroxybenzyl) benzene, tetrakis-[methylene-3 -(3,5-di-t-butyl-4-hydroxyphenyl)propionate[methane, bis[3,3-bis(4-hydroxy-3-t-butylphenyl)butylic acid]clycol ester, tocopherols and the like; paraphenylenediamines such as N-phenyl-N-isopropyl -p-phenylenediamine, N,N-di-sec-butyl-p-phenylenediamine, N-phenyl-N-sec-butyl-p-phenylenediamine, N,N-di-isopropyl-p-phenylenediamine, N,N-dimethyl-N,N-di-t-butyl-p-phenylenediamine, and the like; hydroquinones such as 2,5-di-t-octyl hydroquinone, 2,6-didodecyl hydroquinone, 2-dodecyl hydroquinone, 2-dodecyl-5-chlorohydroquinone, 2-t-octyl-5-methylhydroquinone, 2-(2-octadecenyl)-5-methylhydroquinone, and the like; organosulfur compounds such as dilauryl-3,3-thiodipropionate, distearyl-3,3 -thiodipropionate, ditetradecyl-3,3-thiodipropionate, and the like; and organophosphorus compounds such as triphenylphosphine, tri(nonylphenyl)phosphine, tri (dinonylphenyl)phosphine, tricresylphosphine, tri(2,4-dibutylphenoxy)phosphine, and the like.

Examples of the plasticizer which may be added to each layer are: phosphate plasticizers such as triphenyl phosphate, tricresyl phosphate, trioctyl phosphate, octyldiphenyl phosphate, trichlorethyl phosphate, cresyldiphenyl phosphate, tributyl phosphate, tri-2-ethylhexyl phosphate, triphenyl phosphate, and the like; phthalate plasticizers such as dimethyl phthalate, diethyl phthalate, diisobutyl phthalate, dibutylphthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl phthalate, dioctyl phthalate, and the like; aromatic carboxylate plasticizers such as trioctyl trimellitate, tri-n-octyl trimellitate, octyl oxybenzoate, and the like; aliphatic dibasic acid ester plasticizers such as dibutyl adipate, di-n-hexyl adipate, di-2-ethylhexyl adipate, di-n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate and the like; fatty-acid-ester-derivative plasticizers such as butyl oleate, glycerin monooleate, pentaerythritol ester, dipentaerythritol hexa ester, triacetin, tributylin, and the like; oxalate plasticizers such as methyl acetyl ricinoleate, butyl acetyl ricinoleate, butyl phthalyl butyl glycolate, tributyl acetyl citrate, and the like; epoxy plasticizers such as epoxidated soybean oil, epoxidated linseed oil, butyl epoxystearate, decyl epoxystearate, octyl epoxystearate, benzyl epoxystearate, dioctyl epoxyhexa hydrophthalate, didecyl epoxyhexa hydrophthalate, and the like; dihydric alcohol ester plasticizers such as diethylene glycol benzoate, triethylene glycol di-2-ethyl butylate; chlorine-containing plasticizers such as chlorinated paraffin, chlorinated diphenyl, chlorinated fatty acid methyl esters, methoxy chlorinated fatty acid methyl esters, and the like; polyester plasticizers such as polypropylene adipate, polypropylene sebacate, polyester, acetylated polyesters, and the like; sulfonic acid derivative plasticizers such as p-toluenesulfonamide, o-toluenesulfonamide, p-toluenesulfon-ethylamide, toluenesulfon-N-ethylamide, p-toluenesulfon-N-cyclohexylamide, and the like; citric acid derivative plasticizers such as triethyl citrate, triethyl acetylcitrate, tributyl citrate, tributyl acetylcitrate, tri-2-ethylhexyl acetylcitrate, n-octyldecyl acetylcitrate, and the like; or terphenyl, partially hydrogenated terphenyl, camphor, 2-nitrodiphenyl, dinonylnaphthaline, methyl abietate, and the like.

Examples of the lubricant which may be added to each layer are: hydrocarbons such as liquid paraffin, paraffin wax, microcrystalline wax, microcrystalline wax, oligomers of polyethylenes and the like; fatty acids such as lauric acid, myristic acid, palmitic acid, stearic acid, arachidic acid, behenic acid, and the like; fatty acid amides such as stearylamide, palmitylamide, oleylamide, methylenebisstearoamide, ethylenebisstearoamide, and the like; esters such as lower alcohol esters of fatty acids, polyhydric alcohol esters of fatty acids, fatty acid polyglycol esters, and the like; alcohols such as cetyl alcohol, stearyl alcohol, ethylene glycol, polyethylene glycol, polyglycerol, and the like; metal soaps such as lead stearate, cadmium stearate, barium stearate, calcium stearate, zinc stearate, magnesium stearate, and the like; natural waxes such as carnauba wax, candelilla wax, beeswax, spermaceti wax, Chinese wax, montan wax, and the like; or silicone compounds, fluorine compounds and the like.

Examples of the ultraviolet light absorbents which may be added to each layer are: benzophenone ultraviolet light absorbents such as 2-hydroxybenzophenone, 2,4-dihydroxybenzophenone, 2,2,4-trihydroxybenzophenone, 2,2,4,4-tetrahydroxybenzophenone, 2,2-dihydroxy-4-methoxybenzophenone, and the like; salcylate ultraviolet light absorbents such as phenyl salcylate, 2,4-di-t-butylphenyl-3,5-di-t-butyl-4-hydroxybenzoate, and the like; benzotriazole ultraviolet light absorbents such as (2-hydroxyphenyl)benzotriazole, (2-hydroxy-5-methylphenyl)benzotriazole, (2-hydroxy-3-tertiarybutyl-5-methylphenyl)5-chlorobenzotriazole, and the like; cyanoacrylate ultraviolet light absorbents such as ethyl-2-cyano-3,3-diphenylacrylate, methyl-2-carbomethoxy-3 (para-methoxy)acrylate, and the like; quencher (metal complex) ultraviolet light absorbents such as (nickel(2,2-thiobis(4-t-octyl)phenolate)normal-butylamine, nickel dibutyl dithiocarbamate, nickel dibutyl dithiocarbamate, cobalt dicyclohexyl dithiophosphate, and the like; and HALS (hindered amine) ultraviolet light absorbents such as bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl) propionyloxy]ethyl]-4-[3-(3,5-di-t-buty 1-4-hydroxyphenyl)propionyloxy]-2,2,6,6-tetramethylpyri dine, 6-benzyl-7,7,9,9-tetramethyl-3-octyl-1,3,8-triazaspiro [4,5]undecane-2,4-dione, 4-benzoyloxy-2,2,6, 6-tetramethyl-pyridine, and the like.

As explained above, the image substrate 14 comprises: the photosensitive layer 73 and the protective layer 74 formed on top of the conductive base material; the undercoating layer and the intermediate layer if desired; and the filler in the protective layer 74. As a result, the abrasion resistance is improved, thereby increasing the durability. Further, as explained above, since the existing state of the filler in the protective layer 74 is made constant, the image substrate 14 has excellent durability and stability even in case of high-speed electrophotographic process, and excellent abrasion resistance. Moreover, by supplying zinc stearate on top of the protective layer 74, suppression of "filming" can be achieved while maintaining great abrasion resistance. Furthermore, in the electrophotographic process using the image substrate 14, repetition of, toner adhesion onto the image substrate and toner recovery operation, not during image formation, is effective for suppression of image deletion while maintaining the abrasion resistance.

In the examples, the protective layer 74 that is hard is provided on top of the photosensitive layer 73 of the image substrate 14. However, the invention should not be limited to the examples and is effective even when an image substrate having a hard surface is used, for example, in case of using an image substrate comprising a photosensitive layer made of amorphous silicon.

Figure 5:
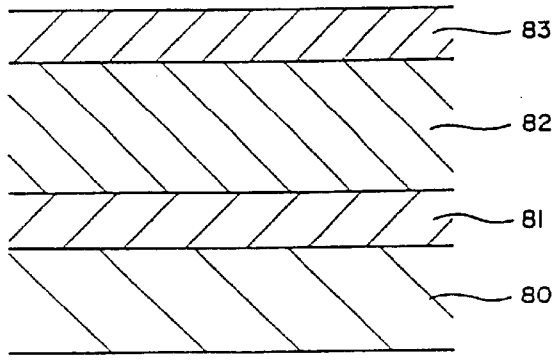
FIG. 5 shows a partial cross-sectional structure of still another image substrate.

The image substrate formed with amorphous silicon consists of a layer principally composed of amorphous silicon containing hydrogen and/or halogen. For example, as shown in FIG. 5, a charge-injection inhibition layer 81 is provided on top of the conductive base material 80, a photoconductive layer 82 is formed on top of the layer 81, and the layer 82 is coated with a surface layer 83.

As the conductive base material 80: aluminium, iron, stainless steel or alloys of these metals; or glass, polycarbonates, acrylic resins or the like, which has undergone conducting treatment; may be used.

As the charge-injection inhibition layer 81, amorphous silicon, wherein a group III element or a group V element is added, is used.

As the photoconductive layer 82, amorphous silicon wherein a group III element is added, is used.

As the surface layer 83: amorphous silicon, containing hydrogen and/or halogen and at least one of the elements selected from a group consisting of carbon, nitrogen, and oxygen; or amorphous carbon, containing hydrogen and/or halogen and at least one of the elements selected from a group consisting of nitrogen and oxygen; is used.

In the example, the image substrate 14 is drum-shaped, however, it can be belt-shaped having similarly a hard surface.

In the color printer explained above, a charge bias is applied at the charging device 40 during image formation. Discharge products such as ozone, nitrogen oxides, or the like are then generated, which deposits onto the image substrate 14, thereby reducing the image quality of the toner image recorded onto the transfer material.

Therefore in this invention, with predetermined timing: the image substrate 14 is rotated in a state where the charging device 40 and the charge bias are off; toner is adhered onto the image substrate 14 with the development device to an extent that upcurve of the cleaning blade 45 is not caused; and the deposit removal operation is executed wherein the deposit on the image substrate 14 is removed with the cleaning device 41.

For example, in a state where the development bias at the development device is off, during 1/15 to 1/5 of time of the deposit removal operation, the development device is driven to rotate the development sleeve and 0.01 to 0.1 mg/cm$^2$ of toner is adhered onto the image substrate 14 with the development sleeve.

As a result, even in case of the image formation apparatus which comprises the protective layer 74 having a hard surface like in FIGS. 4A and 4B, or a hard photo sensitive layer like in FIG. 5, the deposit such as discharge products and the like can be completely removed using the cleaning device 41 for removing the transfer residual toner on the image substrate 14, and reduction of image quality on the transfer material can be prevented over a long period of time.

According to the invention, removal of the deposit can be facilitated, since the deposit removal operation is executed by rotating the image substrate 14 when the charging bias, the main generation source of the deposit, is off. Moreover, using a configuration that is as simple as possible, removal of the deposit during the deposit removal operation can be facilitated, while adhering a minimum appropriate amount of toner on the image substrate to the extent that upcurve of the cleaning blade can be prevented, since the toner is adhered onto the image substrate with the development device when the development bias is off.

Furthermore, since the development device is driven to adhere the toner onto the image substrate during 1/15 to 1/5 of the time of the deposit removal operation; insufficient cleaning of the deposit which occurs in case the operation takes less than 1/5 of the time, or upcurve of the cleaning blade which occurs in case the operation takes more than 1/15 of the time, can be prevented; while the deposit such as the discharge products can be removed completely from the image substrate.

Figure 6:
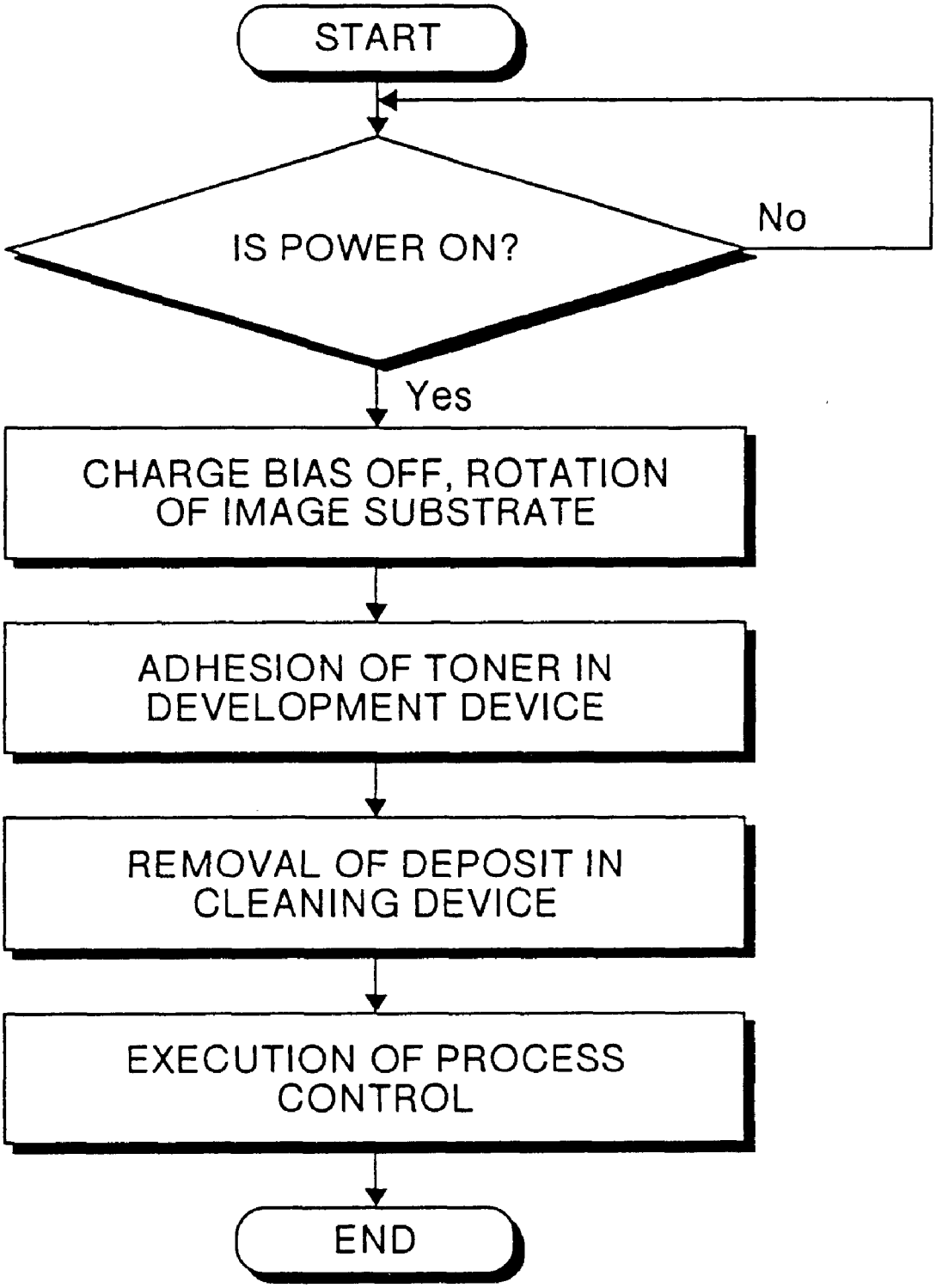
FIG. 6 is a flowchart, which shows an operation for removing the deposit, processed in the printer shown in FIG. 1.

Specifically, as exemplified in FIG. 6: the drive device not shown is driven to rotate the image substrate 14, as the power of the apparatus body A is turned on, while the charge device 40 and the charge bias are off; during 1/10 of the time of the deposit removal operation, the development device is driven to rotate the development sleeve; the toner is adhered onto the image substrate 14 to the extent that upcurve of the cleaning blade 45 is not caused; and the deposit removal operation is executed for 60 seconds. That is, the deposit such as the discharge products, which deposits onto the image substrate 14, is removed by scraping it off with the cleaning blade 45 of the cleaning device 41.

After that, process control is operated. Each color toner image formed in patched form on the image substrate 14 is directly transferred onto the transfer material substrate 18, and the amount of toner in the toner image is detected by a coating-mass detection-sensor provided adjacent to the transfer material substrate 18. The charge bias, the development bias, and the toner concentration in the development unit are controlled considering the value obtained for the amount of toner as the set value.

A toner concentration detection sensor that is equipped in each development unit 13 measures the toner concentration in the development unit 13. When the toner concentration becomes equal to or lower that a certain value, the toner is resupplied to the development unit 13 with a toner supply unit not shown. If the toner concentration does not increase even if the toner supply operation is executed, it is determined that the toner in the toner bottle has run out, and it is instructed to execute replacement or the like of the toner bottle.

When the deposit removal operation is executed as the power is turned on as described, time required for warm-up becomes more or less longer. However, the removal of deposit can be operated without having to set an independent time particularly for the operation, and thus the deposit removal operation will not disturb the image formation operation.

Figure 7:
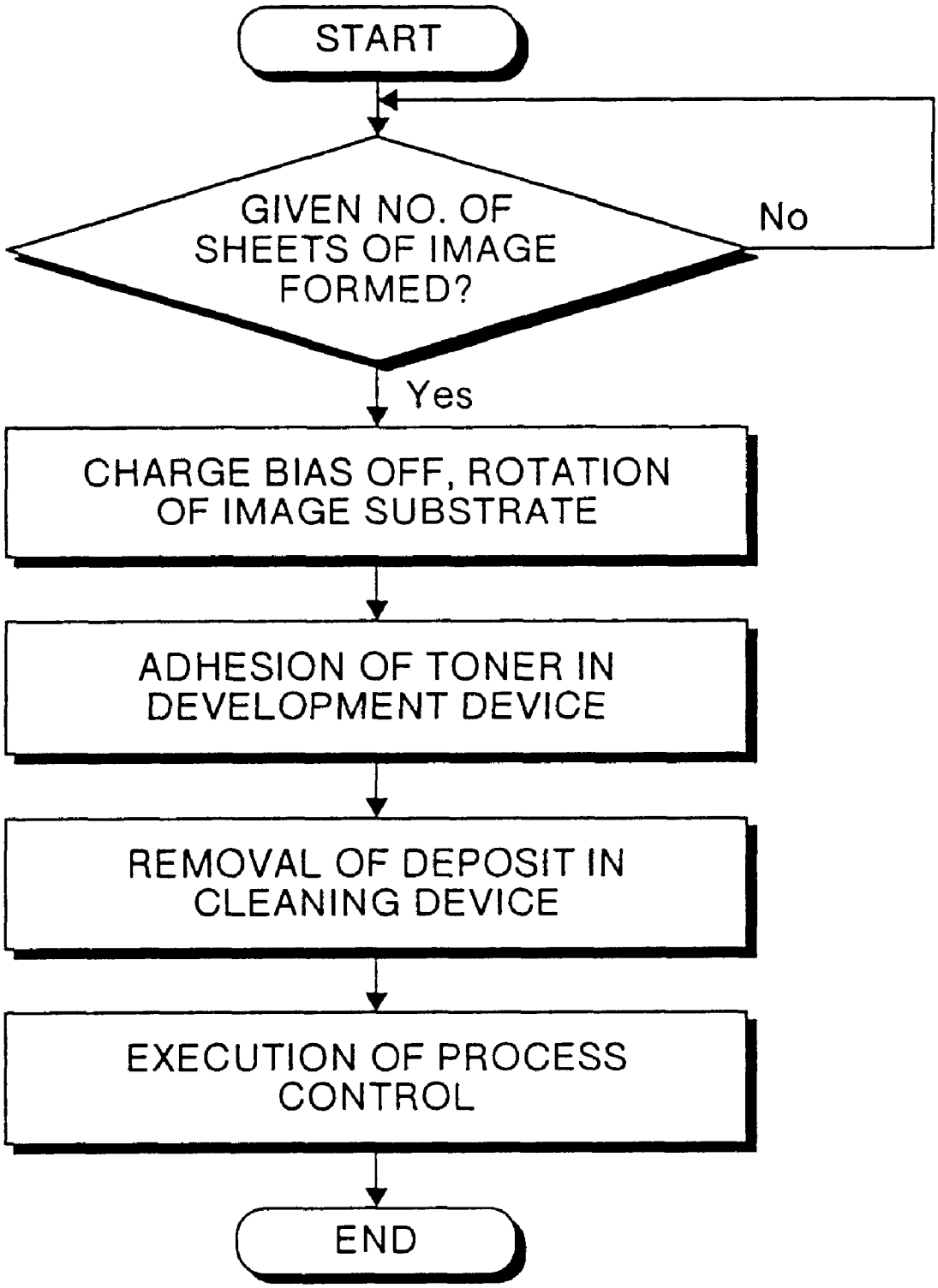
FIG. 7 is a flowchart, which shows another operation for removing the deposit.

In addition, as shown in FIG. 7 for example, the deposit removal operation may be operated for 60 seconds, every predetermined number of sheets of image formed and not as the power is turned on, while the charge bias is off, by rotating the image substrate 14, and driving the development device to adhere the toner onto the image substrate 14 to the extent that upcurve of the cleaning blade 45 is not caused, during 1/10 of the time of the deposit removal operation. In this case, the deposit can be regularly removed for example every 200 sheets processed, to prevent infallibly the reduction of image quality on the transfer material over a long period of time.

Figure 8:
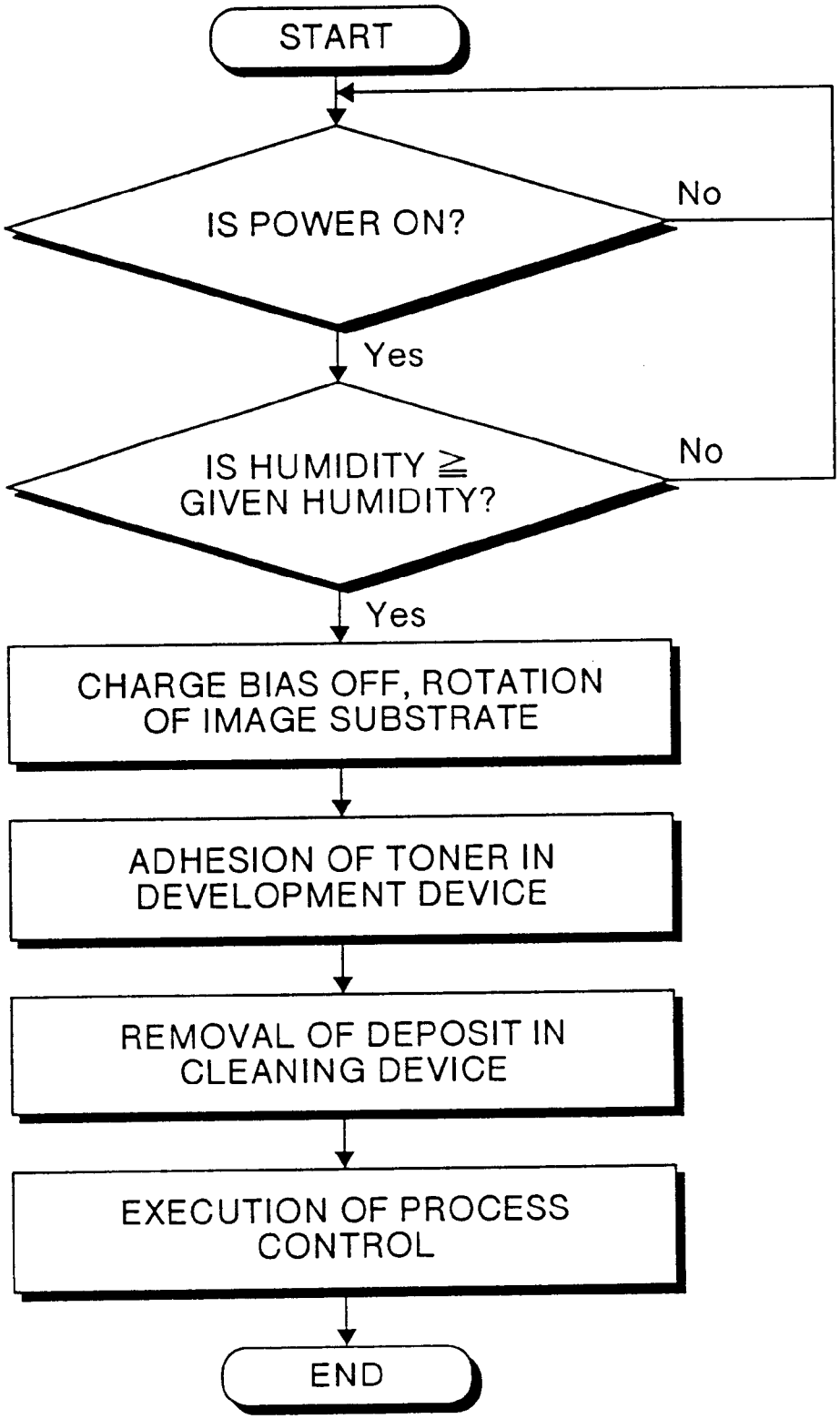
FIG. 8 is a flowchart, which shows still another operation for removing the deposit.
Figure 9:
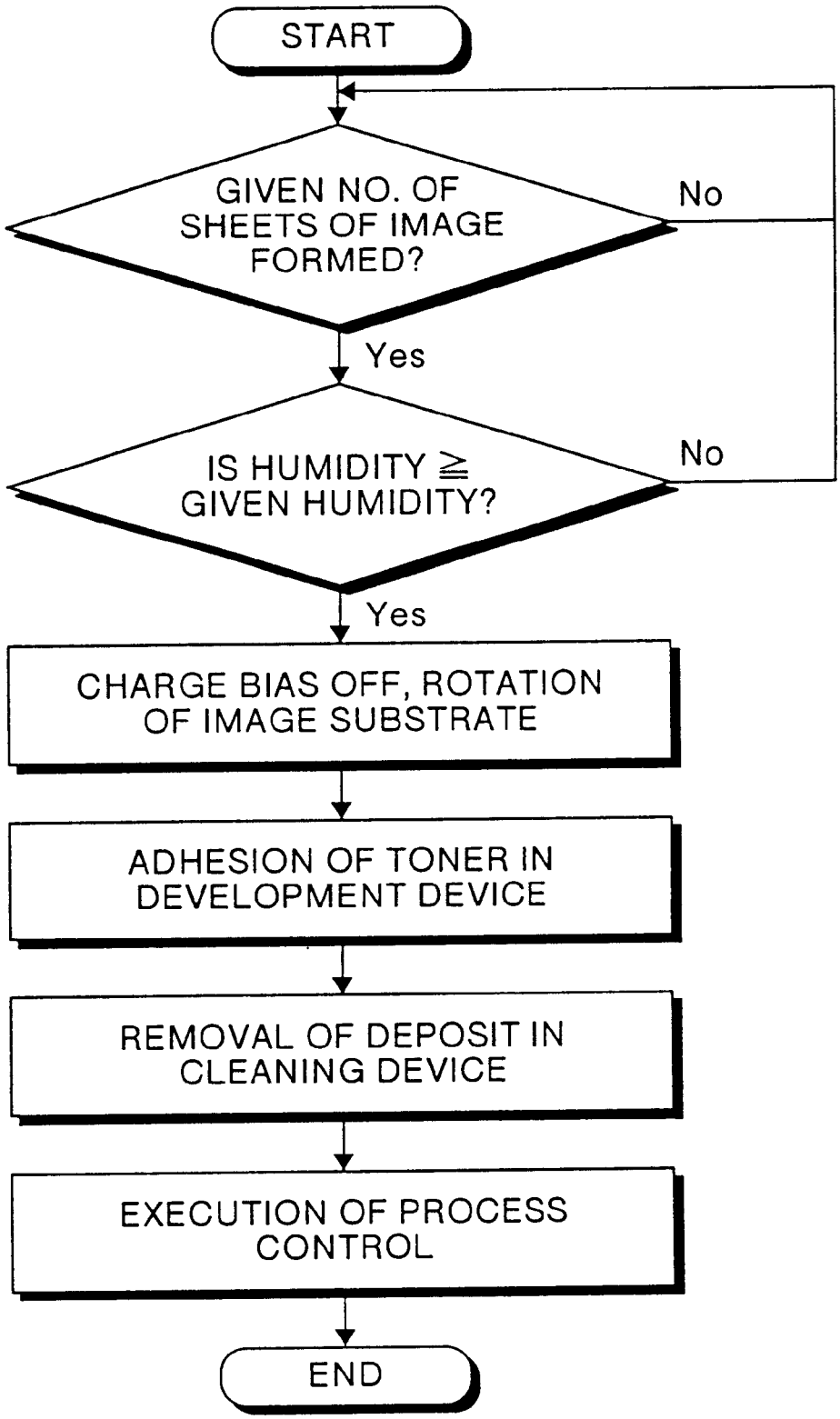
FIG. 9 is a flowchart, which shows a further operation for removing the deposit.

Further, as shown in FIG. 8 for example, when the power is turned on and humidity is equal to or greater than a predetermined humidity, at the development device, the deposit removal operation may be operated, by adhering the toner onto the image substrate 14 to the extent that upcurve of the cleaning blade 45 is not caused. Furthermore, as shown in FIG. 9 for example, when the humidity is equal to or greater than the predetermined humidity, at the development device, the deposit removal operation may be operated by adhering the toner onto the image substrate 14 to the extent that upcurve of the cleaning blade 45 is not caused, per predetermined number of sheets of image formed.

Considering that image deletion in the image formed is easily caused especially when the humidity is high because there is a flow of charge in a section where the electric resistance at surface of the image substrate is reduced and the deposit is adhered, the deposit removal operation may be executed if for example the humidity is 75% or greater. In other words, the deposit may be removed in accordance with the surrounding environment, in particular in a state where the reduction in image quality is easily caused.

The humidity is measured with a humidity sensor for example. The humidity sensor is provided inside the apparatus main body A, in an appropriate position that is spaced apart from the fixing unit 24, for example.

Figure 10:
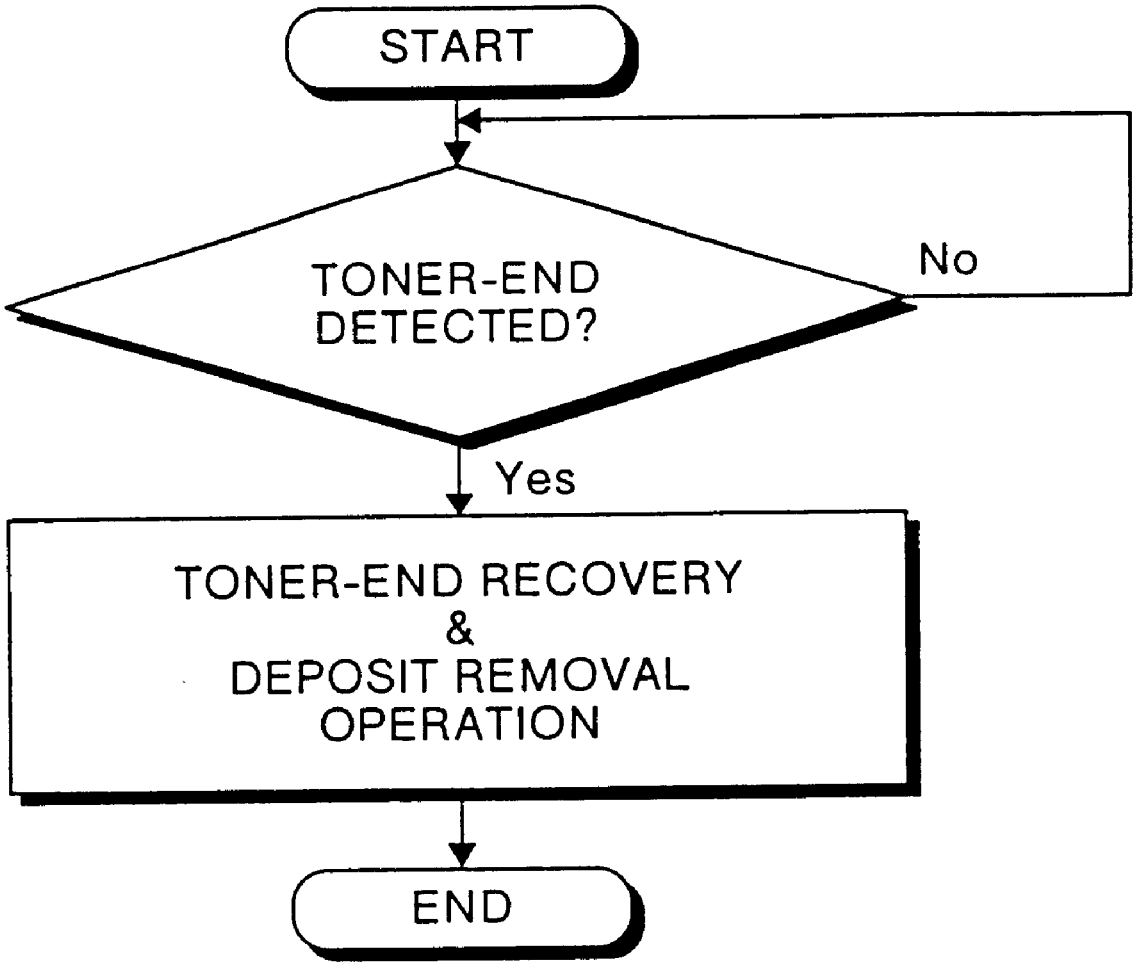
FIG. 10 is a flowchart, which shows yet another operation for removing the deposit.

When the toner concentration detection sensor determines that the toner has run out, the toner is resupplied by, for example, replacing the toner bottle with a new one. As shown in FIG. 10 for example, the deposit removal operation is preferably executed during this toner-end-recovery operation, by adhering the toner onto the image substrate 14 at the development device to the extent that upcurve of the cleaning blade 45 is not caused.

As a result, the deposit removal operation can be executed utilizing the time spent on other operations and while the image formation is not operated; such the deposit removal operation does not interfere with the image formation operation.

To the toner used in the invention, 0.05 to 0.2 wt % of a lubricant, for example, zinc stearate, is preferably added as an external additive. As a result, the lubricant adheres onto the surface of the image substrate 14, and reduces surface energy of the image substrate 14, to prevent "filming" and suppress depositing. Moreover, when the lubricant is in the toner, the deposit can be easily removed as the deposit adheres onto the lubricant. Furthermore, downsizing of the apparatus can be achieved, as a special lubricant application device is not required especially for that purpose, thereby achieving reduction in costs.

The toner principally comprises a binder resin, a colorant, and a charge control agent, and if required, other additives are also added to the toner. Specific examples of the binder resin for use are: styrene-chlorostyrene copolymers such as polystyrene, chloropolystyrene, poly-α-methylstyrene, and the like; styrene resins (polymers and copolymers of styrenes or substituted styrenes) such as styrene-propylene copolymer, styrene-butadiene copolymer, styrene-vinyl chloride copolymer, styrene-vinyl acetate copolymer, styrene-maleic acid copolymer, styrene-acrylate copolymer (styrene-methylacrylate copolymer, styrene-ethyl acrylatecopolymer, styrene-butyl acrylate copolymer, styrene-phenyl acrylate copolymer and the like), styrene-methacrylate copolymer (styrene-methyl methacrylate copolymer, styrene-ethyl methacrylate copolymer, styrene-butyl methacrylate copolymer, styrene-phenyl methacrylate copolymer and the like), styrene-methyl α-chloracrylate copolymer, styrene-acrylonitrile-acrylate copolymer, and the like; and vinyl chloride resins, rosin modified maleic acid resins, phenyl resins, epoxy resins, polyester resins, low-molecular-weight polyethylene, low-molecular-weight polypropylene, ionomer resins, polyurethane resins, ketone resins , ethylene-ethyl acrylate copolymer, xylene resins, polyvinyl butyral and the like.

The colorants (for example, yellow, magenta, cyan and black) used for the toner may be colorants generally known for their use in toners. Amount of the colorant in relation to 100 parts by weight of the binder resin is preferably between 0.1 and 15 parts, more preferably between 0.15 and 9 parts, by weight.

Specific examples of the charge control agent are nigrosine dye, chromium-containing complexes, quaternary ammonium salts, and the like, and these are used accordingly depending on polarity of the toner particles. The amount of the charge control agent in relation to 100 parts by weight of the binder resin is preferably between 0.1 and 10 parts, more preferably between 0.2 and 7 parts, by weight.

In addition, a superplasticizer is preferably added to the toner particles. Examples of the superplasticizer for use are: particles of metal oxides such as silica, alumina, magnesia, zirconia, ferrite, magnetite, and the like; particles of fatty acids or fatty acid metallic salts such as stearic acid or zinc stearate; particles of polymers such as polystyrene, methyl polymethacrylate, vinylidene polyfluoride, and the like; and these particles surface-treated or coated with silane coupling agent, titanate coupling agent, zirconia aluminate, quaternary ammmonium salts, fatty acids, fatty acid metallic salts, fluorine activators, solvents, or polymers. Particle diameter of the superplasticizer to be used is preferably between 0.01 and 3 μm.

Amount of the superplasticizer added in relation to 100 parts by weight of the toner particles is preferably between 0.1 and 7.0,more preferably between 0.2 to 5.0 parts, by weight. To mix the toner particles with the superplasticizer, the powder of these is moved at high speed by an airstream or a mechanical force in a fluid state, practically without being crushed. High-speed fluidizationmixers, for example, a Henshel mixer, a UM mixer, and the like may be used as a mixer.

To produce the two-component development toner, various generally known methods, or a method combining any of these methods, may be used. For example, a kneading and grinding method wherein a mixture, comprising the binder resin, the colorant such as carbon black or the like and any required additives, undergoes dry-blending, then hot-fusion-kneading using an extruder, a two-roll, a three-roll, or the like, and cooling to be solidified. After that, the mixture is ground in a grinder such as a jet-mill, and the ground particles are classified using an air classifier to obtain the toner. The toner can be also directly produced from a monomer, a colorant, and additives, using a suspension polymerization method or a nonaqueous dispersion polymerization method.

A carrier core material consisting of itself, or a core material coated with a coating layer, is generally used. The core material used for a resin-coated carrier, which can be used in the invention, is ferrite or magnetite. Particle diameter of the core substance is preferably between 20 and 65 μm, more preferably between 30 and 60 μm.

Examples of fluorine-containing monomers which can be used for forming the carrier coating layer are: vinylidene fluoride, tetrafluoroethylene, hexafluoropropylene, perfluoro-alkyl-vinylether, vinylethers substituted with fluorine atoms, vinylketones substituted with fluorine atoms; polymers of these monomers such as vinylidene fluoride-tetrafluoroethylene copolymer, vinylidene fluoride-hexafluoropropylene copolymer, perfluoro alkyl vinylether-vinylidene fluoride-tetrafluoroethylene copolymer, vinylidene fluoride polymers, tetrafluoroethylene copolymers, vinylether-containing polymers substituted with fluoride atoms, vinylketone-containing polymers substituted with fluorine atoms, fluorinated alkylacrylate polymers, fluorinated alkylmethacrylate polymers, and the like.

Examples of components which can be used for copolymerization with the fluorine-containing monomers are: styrene, methylstyrene, dimethylstyrene, trimethyl styrene, acrylic acid, methacrylic acid, methyl acrylate, methyl methacrylate, butyl acrylate, butyl methacrylate, benzyl acrylate, benzyl methacrylate, acrylic amide, methacrylic amide, cyclohexyl acrylate, cyclohexyl methacrylate, hydroxyethyl acrylate, glycidyl acrylate, glycidyl methacrylate, vinyl acetate, ethylene, propylene, and the like.

To form the coating layer, the resin is applicated on surface of the carried core particles by spray-coating, dip-coating, or the like, as conventionally done.

In the examples above, the invention is explained relating to cases of using it for the color printer. However, the invention may be used similarly for copiers, facsimile machines, and other image formation apparatuses. Further, it is not limited to full-color uses, and may be used for two-color or monochrome image formation apparatuses.

As explained above, according to the invention relating to claim 1, to execute the deposit removal operation, with predetermined timing, the image substrate is rotated while the charging device is off, and the toner is adhered onto the image substrate to an extent that upcurve of the cleaning blade is not caused, at the development device. As a result, even in the image formation apparatus comprising the hard protective layer or the hard photosensitive layer on the surface on the image substrate, the deposit such as discharge products and the like can be removed completely from the image substrate, using the cleaning device that removes the transfer residual toner from the image substrate, and thus degradation of the image quality on the transfer material can be prevented over a long period of time.

The image substrate is rotated to execute the deposit removal operation while the charge bias, that is the main source of depositing, is off, the removal of the deposit can be facilitated.

In a state where there is the deposit on the image substrate, the toner concentration on the image substrate becomes lower, and if process control is executed in this state, the toner concentration is increased unnecessarily thereby possibly causing toner splash. Therefore the invention can prevent occurrence of such problems.

Moreover, since the deposit removal operation is executed by adhering the toner to the extent that upcurve of the cleaning blade is not caused, the deposit removal operation can be done while preventing upcurve of the cleaning blade, consuming only a minimum amount of the toner.

According to the invention relating to claim 2, since the deposit removal operation is executed as the power is turned on, although time required for warm-up becomes longer more or less, the removal of the deposit can be done without having to hold a dependent period of time especially for the deposit removal operation, and thus the deposit removal operation does not interfere with the image formation operation.

According to the invention relating to claim 3, since the deposit removal operation is executed per a predetermined number of sheets of image formed, the deposit can be removed regularly for example per 200 sheets to prevent infallibly the reduction in the image quality on the transfer material over a long period of time.

According to the invention relating to claim 4, the deposit removal operation is executed when the humidity is equal to or greater than a certain value, for example, when the humidity is 75% or greater. Considering the fact that there is a flow of charge in the section, on the surface of the image substrate, where the electrical resistance becomes lower, and that the image deletion is easily caused in the image formed especially at higher humidity, the deposit removal operation is to be executed when the humidity is high, that is, the deposit is to be removed in accordance with the surrounding environment, especially when the reduction in the image quality is likely to be caused.

According to the invention relating to claim 5, the deposit removal operation is executed during the toner-end recovery operation such as the toner bottle replacement or the like. That is, since the deposit removal operation is executed utilizing the time spent on operations other than the image formation operation, the deposit removal operation does not interfere with the image formation operation.

According to the invention relating to claim 6, the toner is adhered onto the image substrate at the development device while the development bias is off, the removal of the deposit during the deposit removal operation can be facilitated with the configuration that is as simple as possible, by adhering the minimum optimum amount of toner onto the image substrate to an extent that upcurve of the cleaning blade can be prevented.

According to the invention relating to claim 7, the toner is adhered on to the image substrate in the development device during 1/5 to 1/15 of the time of the deposit removal operation. As a result, the deposit such as the charge products and the like can be removed completely from the image substrate while insufficient cleaning that occurs if it takes less than 1/15 of the time, or upcurve of the cleaning blade that is caused if it takes more than 1/5 of the time, can be prevented.

According to the invention relating to claim 8, since the lubricant is added to the toner as the external additive, the lubricant adheres onto the surface of the image substrate, reduces the surface energy, prevents "filming", suppresses depositing on the image substrate, and facilitates the detachment of the deposit from the image substrate.

According to the invention relating to claim 9, the image formation apparatus having the above effects is provided since it comprises the method of removing the deposit from the image substrate, which is described in one of claims 1 to 8.

The present document incorporates by reference the entire contents of Japanese priority documents, 2000-317374 filed in Japan on Oct. 18, 2000, 2001-120787 filed in Japan on Apr. 19, 2001 and 2001-276754 filed in Japan on Sep. 12, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of removing deposit from a surface of an image substrate of an image formation apparatus wherein transfer residual toner on said image substrate is removed using a cleaning blade of a cleaning unit, such that, an operation for removing the deposit: by rotating said image substrate while a charge bias is off, and adhering a toner onto said image substrate to an extent that upcurve of said cleaning blade is not caused, at a development unit, to remove the deposit on said image substrate using said cleaning unit; is executed with predetermined timing.

2. The method according to claim 1, wherein the predetermined timing is when power of said image formation apparatus is turned on.

3. The method according to claim 1, wherein the predetermined timing is when a predetermined number of sheets of image are formed.

4. The method according to claim 1, wherein the predetermined timing is when humidity is equal to or higher than a predetermined value.

5. The method according to claim 1, wherein the predetermined timing is during when a toner-end recovery operation is being performed.

6. The method according to claim 1, wherein said development unit supplies the toner to said surface of said image substrate while a development bias is off.

7. The method according to claim 1, wherein the toner is supplied to said surface of said image substrate during a period which is 1/15 to 1/5 time a time required for cleaning the deposit from said surface of said image substrate.

8. The method according to claim 1, wherein a lubricant is added to the toner.

9. An image formation apparatus comprising:

an image substrate having a surface;

a rotating unit that rotates said image substrate;

a bias applying unit which applies a charge bias to said surface of said image substrate;

a development unit that supplies a toner onto said surface of said image substrate; and a cleaning unit which includes a cleaning blade that removes the material deposited on said surface of said image substrate, wherein while no charge bias is applied to said surface of said image substrate by said bias applying unit, said rotating unit rotates said image substrate, said development unit supplies the toner to said surface of said image substrate to an extent that upcurve of said cleaning blade is not caused and said cleaning blade removes the material deposited on said surface of said image substrate, wherein the rotation of said image substrate, supply of toner to said surface, and removal of the deposited material from said surface are executed a predetermined timing.

10. The image formation apparatus according to claim 9, further comprising a switch for turning on/off of a power to said image formation apparatus, wherein the predetermined timing is when said switch is operated to turn on the power of said image formation apparatus.

11. The image formation apparatus according to claim 9, further comprising a counting unit which counts a number of sheets of images, wherein the predetermined timing is when said counting unit has counted up to a predetermined number.

12. The image formation apparatus according to claim 9, further comprising a humidity measuring unit which measures atmospheric humidity, wherein the predetermined timing is when the humidity measured by said humidity measuring unit is equal to or higher than a predetermined value.

13. The image formation apparatus according to claim 9, further comprising a toner-end detecting unit for detecting an end of the toner; and a toner-end recovery operation performing unit which performs a toner-end recovery operation when said toner-end detecting unit has detected the end of the toner, wherein the predetermined timing is during when a toner-end recovery operation is being performed by said toner-end recovery operation performing unit.

14. The image formation apparatus according to claim 9, wherein said development unit supplies the toner to said surface of said image substrate while a development bias is off.

15. The image formation apparatus according to claim 9, wherein said development unit supplies the toner to said surface of said image substrate during a period which is 1/15 to 1/5 times a total time required for the rotation of said image substrate, supply of toner to said surface, and removal of the deposited material from said surface.

16. The image formation apparatus according to claim 9, wherein a lubricant is added to the toner.

17. A method of removing a material deposited on a surface of an image substrate of an image formation apparatus, said image formation apparatus including a rotating unit that rotates said image substrate, a bias applying unit which applies a charge bias to said surface of said image substrate, a development unit that supplies a toner onto said surface of said image substrate, and a cleaning unit which includes a cleaning blade that removes the material deposited on said surface of said image substrate, the method comprising the processes of:

not applying the charge bias by said bias applying unit to said surface of said image substrate;

rotating said image substrate;

supplying the toner to said surface of said image substrate, using said development unit, to an extent that upcurve of said cleaning blade is not caused;

removing the material deposited on said surface of said image substrate using said cleaning blade, wherein the method is executed a predetermined timing.

* * * * *